US010276317B2

(12) United States Patent
Dambietz et al.

(10) Patent No.: US 10,276,317 B2
(45) Date of Patent: Apr. 30, 2019

(54) SNAP-ACTION DRIVE AND SWITCHING DEVICE HAVING A SNAP-ACTION DRIVE

(71) Applicant: SIEMENS AKTIENGESELLSCHAFT, Munich (DE)

(72) Inventors: Hans-Peter Dambietz, Berlin (DE); Christian Dengler, Falkensee (DE); Frank Ehrlich, Hohen Neuendorf (DE); Roland Monka, Berlin (DE); Ingolf Reiher, Berlin (DE); Stefan Rossa, Berlin (DE); Peter Schmidt, Berlin (DE); Marcel Weigel, Berlin-Blankenburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/672,842

(22) Filed: Aug. 9, 2017

(65) Prior Publication Data

US 2018/0047524 A1 Feb. 15, 2018

(30) Foreign Application Priority Data

Aug. 9, 2016 (DE) ..... 10 2016 214 783

(51) Int. Cl.

| | |
|---|---|
| ***H01H 5/10*** | (2006.01) |
| ***H01H 33/40*** | (2006.01) |
| ***H01H 33/42*** | (2006.01) |
| ***H01H 33/50*** | (2006.01) |
| ***H01H 3/30*** | (2006.01) |

(Continued)

(52) U.S. Cl.

CPC ..... *H01H 5/10* (2013.01); *H01H 3/30* (2013.01); *H01H 5/06* (2013.01); *H01H 33/40* (2013.01); *H01H 33/42* (2013.01); *H01H 33/50* (2013.01); *H01H 3/004* (2013.01); *H01H 2003/3057* (2013.01)

(58) Field of Classification Search

CPC .. H01H 5/10; H01H 5/06; H01H 3/30; H01H 33/40; H01H 33/42; H01H 33/50

USPC ..... 200/400

See application file for complete search history.

(56) References Cited

U.S. PATENT DOCUMENTS 6,232,570 B1 * 5/2001 Castonguay ..... H01H 1/2041 200/237
7,474,179 B2 * 1/2009 Weister ..... H01H 1/226 200/244

(Continued)

FOREIGN PATENT DOCUMENTS

DE 19925537 A1 12/2000
DE 102013207215 A1 10/2014

(Continued)

OTHER PUBLICATIONS

DE19925537 (WO2000075946) , Dirks et al., Dec. 2000, machine translation.*
EP2040276, Perrin, Mar. 2009, machine translation.*

*Primary Examiner* — Kyung S Lee
(74) *Attorney, Agent, or Firm* — Laurence Greenberg; Werner Stemer; Ralph Locher

(57) ABSTRACT

A snap-action drive for a switching device has an energy store, a swinging movable part and a securing device for the movable part. The securing device secures a position of the swinging movable part by a force effect, wherein a reversal of direction of the movable part takes place counter to the force effect.

15 Claims, 10 Drawing Sheets

(51) Int. Cl.
*H01H 5/06* (2006.01)
*H01H 3/00* (2006.01)

(56) References Cited

U.S. PATENT DOCUMENTS

| | | | | |
|---|---|---|---|---|
| 9,349,560 | B2 * | 5/2016 | Rane | H01H 73/02 |
| 2010/0155210 | A1 * | 6/2010 | Godesa | H01H 3/3005 200/400 |

FOREIGN PATENT DOCUMENTS

| | | | |
|---|---|---|---|
| DE | 102014203902 | A1 | 9/2015 |
| EP | 0058585 | A1 | 8/1982 |
| EP | 2040276 | A1 | 3/2009 |

* cited by examiner

SNAP-ACTION DRIVE AND SWITCHING DEVICE HAVING A SNAP-ACTION DRIVE

CROSS-REFERENCE TO RELATED APPLICATION

This application claims the priority, under 35 U.S.C. § 119, of German application DE 10 2016 214 783.8, filed Aug. 9, 2016; the prior application is herewith incorporated by reference in its entirety.

BACKGROUND OF THE INVENTION

Field of the Invention

The invention relates to a snap-action drive for a switching device having an energy store, a swinging movable part of a gear mechanism and a securing device for the movable part.

A snap-action drive is known, for example, from published, non-prosecuted German patent application DE 10 2014 203 902 A1. The snap-action drive in the application is configured for a switching device, wherein the snap-action drive has an energy store. The energy store interacts with a swinging movable part of a gear mechanism, wherein a securing device is provided for preventing undesired movements of the movable part. The securing device is configured here in such a way that recesses into which a bolt element of the securing element can be moved are formed in the movable part. As a result, a movement of the movable part in the application can be blocked. Retraction and extension of the bolt element are controlled as a function of a change in position of the energy store in the application.

A disadvantage with such a solution is that time intervals occur in which the movable part is not secured. However, such unsecured time intervals constitute a risk for the reliable functioning of the snap-action drive. Although a play-free configuration of the mechanism can result in a reduction in the unsecured time intervals, this measure becomes ineffective as the wear increases, and the risk of undefined movements of the movable part therefore increases.

SUMMARY OF THE INVENTION

The resulting object of the invention is therefore to specify a snap-action drive which has improved operational reliability.

The object is achieved with a snap-action drive of the type mentioned at the beginning by virtue of the fact that a reversal of direction of the movable part takes place counter to a force effect of the securing device.

A snap-action drive for a switching device is an apparatus which serves to operate a switching device. A switching device can have switching contact pieces which can move relative to one another and which have to be moved relative to one another in order to change a switched state. A snap-action drive can be used to bring about a relative movement of the switching contact pieces with respect to one another. A snap-action drive has here the advantage that a movement which is output, that is to say the movement which is used for the relative movement of the switching contact pieces, can occur continuously virtually independently of external peripheral conditions. For this purpose, the snap-action drive has an energy store which buffers energy which is necessary to activate or output a movement to switching contact pieces which can move relative to one another. The energy store can be, for example, a mechanical energy store, such as a storage spring, which has a gas spring, a hydraulic spring, a mechanical spring etc. In order to be able to extract energy from the energy store, the energy store firstly has to be charged. The charging of this energy store is carried out here independently of the type of movement to be output by the snap-action drive. For example, the energy store can be charged during a longer time interval than the time interval in which the discharging of the energy store is provided. A snap-action drive can operate here in such a way that when a switching action is triggered charging of the energy store firstly takes place. When a predefined state of charge of the energy store is reached, a predefined snap-action-like discharging of the energy store can take place (forcibly). A snap-action drive can be configured in such a way that charging of the energy store occurs only when a switching action is requested, wherein the energy store is at least partially discharged after a switching action has taken place. This has the advantage that charging and therefore loading of the energy store takes place only when necessary, and only temporarily. It is not necessary to keep energy available in the energy store, for example between two switching actions.

The snap-action drive can have a gear mechanism which has a swinging movable part. The energy store can be part of the gear mechanism, wherein the energy store can be charged and/or discharged via the gear mechanism. A swinging movable part has the advantage that a reversal of direction of movement can be generated on the movable part. The movable part can therefore be moved alternately between a point A and a point B, wherein the output of a snap-action-like driving movement is possible by the snap-action drive both during a forward movement and a return movement. The movable part can also perform a snap-action-like movement. As a result, a switch-on movement and a switch-off movement at the switching device can be carried out with the same snap-action drive, in each case with snap-action-like movement profile. Swinging can be provided along various types of trajectories. Therefore a swinging movable part can, for example, be moved in a translatory fashion or can be moved on a circular path or can perform a forward movement and return movement on a path which is suitable in some other way. A forward movement can serve, for example, to switch on a switching device. A return movement can serve, for example, to switch off a switching device. The swinging movable part can assume a position of rest at the turning points. By means of a securing device for the movable part it is possible to secure the swinging movable part in suitable positions, for example in end positions (turning points) of the movable part. This can prevent undefined movement of the movable part. The securing device can advantageously be configured in such a way that a plurality of positions of the movable part can be secured by the securing device. The movable part can preferably be secured by the securing device at the turning point at which a reversal of movement of the movable part takes place during a swing. As result it is possible to allow the movable part to carry out, as necessary, only one pass from one end point to another end point of the swinging movable part. In particular, the securing device can force the movable part into a position to be secured.

The securing device can apply a force effect to the swinging movable part. The free mobility of the movable part can be restricted by the force effect. In this context, the swinging movable part can be secured in position, for example, by means of weight force, spring force or other suitable forces. A reversal of direction of the movable part, e.g. at turning points of a trajectory profile of the swinging movable part, can take place here in such a way that a force which is brought about by the securing device has to be overcome. During a reversal of the direction of movement, the swinging movable part is therefore secured constantly. In particular, during a swinging phase a force effect can be applied to the movable part by the securing device at any point in time during the swinging or at any location on the movement path of the movable part. This prevents free swinging. On the one hand, an increased expenditure of force is required to drive the movable part, so as to overcome the force effect of the securing device, but on the other hand this also brings about interruption-free securement of the swinging movable part. The use of a force-controlled securing device makes it possible to permit, for example, self-regulating action of the securing device. For example, depending on the force conditions which occur at the gear mechanism it is possible to define certain limiting forces under which the securing device is effective, whereas when the limiting forces are exceeded the force effect of the securing device is neutralized and a movement of the swinging movable part is forcibly brought about (by overcoming the force effect of the securing device).

A further advantageous refinement can provide that the movable part and the securing device form a bistable system.

The movable part can swing between end positions. In this context, the securing device can be embodied in such a way that it brings about stabilization or securement of the movable part at a plurality of points on the movement path of the swinging movable part, in particular at the turning points of a swinging movement. By means of such an action a symmetrical movable part can be formed, wherein a forward movement and return movement of the movable part can be performed in each case in a snap-action-like fashion. As a result, for example both switching on and switching off can take place in a snap-action-like fashion, with the result that both switching on and switching off of switching contact pieces which can move relative to one another has a reliable switching behavior. As result of bistable positions, in particular of the movable part, a renewed switching movement can be triggered directly after the conclusion of a switching movement. In addition to the stable positions, i.e. preferably the end positions/turning points of the swinging movable part, unstable positions can result which can be overcome by the effect of the securing device. The securing device can drive the swinging movable part back into stable positions, preferably into the respective end position. Undefined unstable intermediate positions can be overcome quickly and securement in the end positions can take place. An end position of the swinging movable part can correspond to an "On" state or an "Off" state of a switching device.

A further advantageous refinement can provide that the movable part assumes an unstable state when the energy store is charged.

During charging of the energy store there can be provision that an unstable position is assumed by the movable part. The movable part can be driven, for example, into an intermediate position between the stable end positions, wherein, for example, the energy from the charged energy store can be used for this purpose. For example, the energy from the charged energy store can have such absolute values that the force effect of the securing device on the swinging movable part is exceeded, with the result that the effect of the securing device is neutralized. When the unstable state is reached, a snap-action-like deflection of the swinging movable part can preferably be brought about. This movement can be promoted at least temporarily by the securing device.

Furthermore there can advantageously be provision that the movable part acts as a lag element in the gear mechanism.

A lag element within a gear mechanism permits a movement to be transmitted in a delayed fashion (or a transmission of a movement to be temporarily suspended). Using a lag element provides the possibility of making available a time interval for the charging of the energy store, wherein no change occurs at the output of the gear mechanism. In this way, within the gear mechanism an idling possibility is generated which permits temporary decoupling of a transmission of a movement. It is therefore possible, for example, that when a storage spring is used as an energy store tensioning of the storage spring takes place, wherein a tensioning movement is not transmitted immediately by the gear mechanism owing to the function of the lag element. This provides the possibility of tensioning the storage spring during a switching process and of discharging the energy stored in the storage spring in a snap-action-like fashion.

Furthermore, there can advantageously be provision that the securing device has a dead-center spring.

A dead-center spring provides the possibility of implementing stable securement of a position of the swinging movable part in a plurality of positions by means of the securing device. It is therefore possible for stable pressure or stable generation of a force effect for securing a position of the movable part to be output by the securing device before or after a dead-center of a dead-center spring is traversed. In this context, the direction of the force effect of the dead-center spring can vary. A dead-center spring can be implemented, for example, using a toggle lever, wherein a dead-center position can be defined in an extended position of the toggle lever. Correspondingly, in this way a dead-center spring can also be formed which, at a changeover between end positions located on each side of the dead center, permits a dead center to be dipped through. In this context, a lever arm of a toggle lever gear mechanism can be subjected to elastic deformation, with the result that driven flipping over of the toggle lever is made possible.

In a further advantageous refinement there can be provision that the energy store has a dead-center spring.

The energy store can have a dead-center spring. In this context, the energy store itself or a storage spring which acts as an energy store can act as a dead-center spring. As result it is possible, for example, for slow tensioning of the storage spring to be performed until a dead center is reached or passed through, wherein when the dead center of the storage spring is passed through a snap-action-like release or discharging of the storage spring occurs. It is therefore possible always to achieve a defined identical output of a drive movement by a snap-action drive on a snap-action drive independently of the form of the charging of an energy store.

Furthermore, it can be advantageous that the dead centers of the dead-center springs of the securing device and of the energy store apply force effects to the movable part in opposing directions.

A plurality of dead-center springs can interact with one another in their dead-center positions. It is thus possible, for example, that the dead-center springs apply force effects to the movable part in opposing directions. As result, for example during a switching movement, the overcoming of the one dead center of the one dead-center spring can be forcibly brought about by moving the other dead-center spring. Furthermore, the possibility is provided that the dead-center spring of the energy store traverses its dead center and counteracts the force effect of the securing device (dead-center spring), and the dead-center spring of the securing device is driven through a dead center.

In this context there can be advantageously provision that a traversing of a dead center of a dead-center spring, in particular of the energy store, causes a stable state of the bistable state to change.

As result of dead centers of a plurality of dead-center springs being passed through in chronological succession it is ensured that at least one of the dead-center springs drives the movable part into a defined (end) position. During a traversal of a dead center of one dead-center spring, the other dead-center spring can maintain a securing function or can forcibly bring about secure driving of a movement in a preferred direction or with a preferred direction. When the dead center of the dead-center spring of the energy store is traversed, the possibility is therefore provided of forcibly bringing about overriding of a swinging movement of the movable part. This provides a precondition for making the snap-action drive switchable for a reversed switching movement and for permitting a movement of the gear mechanism to be run through "in reverse".

In this context there can advantageously be provision that the dead centers of the dead-center springs are traversed in chronological succession.

The dead-center springs can advantageously pass through their respective dead center in chronological succession. Therefore, it is possible to forcibly bring about a movement sequence according to which the gear mechanism operates. There can be provision, for example, that the respective movement paths in the gear mechanism are run through with reverse direction both in the switching-on process and in the switching-off process, that is to say in each case after a reversal of movement, in particular of the swinging movable part. In this context, for example in the case of a switching-on movement, the section of a movement path which serves initially to tension or charge an energy store can correspond during a switching-off movement to the section of the movement path for discharging the energy store (and vice versa). In this way, during a forward movement of the swinging movable part the interval of the movement which serves to tension the energy store can serve to discharge the energy store during a return movement (and vice versa). Therefore, a closed movement path (swinging movement) is achieved, wherein intervals of the movement path can serve alternately both for charging the energy store and also discharging the energy store. In this context, the path of the forward movement of the movable part corresponds to the path of the return movement of the movable part. The discharging and charging sections of the path can in this case alternate (with one another).

In this context, there can advantageously be provision that the swinging movable part is driven by outputting of energy from the energy store of the snap-action drive.

The energy store of the snap-action drive serves to buffer energy. There is therefore the possibility of charging the energy store during a comparatively long time period and of permitting discharging of the energy store during a comparatively short time period. The distance travelled for charging and discharging should be of the same length in each case. In this way a symmetrical sequence of a movement, in particular of the movable part, can occur. A defined output of drive energy, for example to switching contact pieces of a switching device, can always take place independently of a driving movement or incoming energy at the gear mechanism. The swinging movable part can be, for example, a lever which is seated on a drive shaft, wherein the drive shaft can perform a rotational movement. Correspondingly, the movable part can be arranged, for example in the manner of a single-arm lever or two-arm lever, on the shaft and perform a pivoting movement. Alternatively it is also possible to provide that the swinging movable part is, for example, arranged in a linearly displaceable fashion and that, for example, a linear movement can be output by the gear mechanism.

Furthermore it is advantageous to provide that the gear mechanism has a slotted link, by means of which charging, and/or discharging of the energy store is controlled.

A slotted link controls transmission of a movement through its shape. For example, a slotted link can serve to transmit a movement, in the manner of a groove or a slot or a circumference of a cam plate. In this context, a sensing element can sense, in particular, a body edge of the slotted link, and in the case of a relative movement of the slotted link with respect to the sensing element a relative movement can be forcibly brought about at the sensing element. Conversely, a movement can also be applied to the sensing element, and a movement of the slotted link can be achieved as a consequence thereof. In this context, the shape of the slotted link should have been embodied in such a way that it acts in a self-locking way, with the result that an independent return movement or resetting is prevented. A slotted link can have, for example, the profile of a circular segment about a center of rotation, wherein the slotted link can be sensed by a sensing element. A sensing element can be, for example, a sliding block which is positioned in a sliding fashion in a groove. When the position of the sliding link changes, a movement can also be produced at the sliding block, as result of which a movement can be derived from the slotted link (and vice versa). The slotted link can bring about, for example, forced guidance of a sensing element. Furthermore, a process can be controlled via a slotted link. It is therefore possible, for example, to implement a slotted link controller by means of which process steps which are determined as a function of the progress of a relative movement between the slotted link and the sensing element can be triggered. In this way it is advantageous, for example, when charging and/or discharging of the energy store can be controlled as a function of the position of a slotted link. In this context, the slotted link can serve, for example, to perform forcible guidance of a storage-charging movement. However, it can also be provided that the slotted link is forcibly guided by a movement which is brought about by the energy store. During a switching process, both a charging movement and a discharging movement of the energy store can advantageously be forcibly brought about by the slotted link. On the other hand, a movement of the slotted link can also be forcibly brought about by the energy store. A lag element can be embodied by means of a slotted link in that a movement is not transmitted or is neutralized owing to the shape of the slotted link.

Furthermore it can be advantageously provided that the slotted link has at least one end stop for bounding a movement which can be output by the gear mechanism.

The slotted link can also make available an end stop in order to bound a movement which can be output by the gear mechanism. In this context, the slotted link can have, for example, two end stops which are arranged at the ends and between which the slotted link can be sensed. When a sensing element impacts against the end stops, a movement can be applied to the slotted link or from the slotted link, as result of which, for example, a drive movement can be output by the snap-action drive. The slotted link can also act, for example, as a lag element. In particular, the slotted link can be arranged on the swinging movable part.

One advantageous refinement can provide that the swinging movable part is mounted in a rotationally movable fashion.

A swinging movable part can be arranged in a rotationally movable fashion. In this case, the movable part can be arranged projecting radially from the rotational axis. This provides the possibility of pivoting the movable part about a rotational axis. Pivoting provides the advantage here that, for example, movement through or assumption of a dead-center position of, for example, a dead-center spring can easily be brought about, wherein a partial rotational movement of the swinging movable part can also be possible before and after movement through the dead center. A slotted link can at least partially run, for example, with an essentially radial orientation with respect to the rotational axis of the movable part.

A further advantageous refinement can provide that a storage-charging mechanism has an, in particular, two-armed storage-charging lever which is rotatably mounted.

A storage-charging mechanism is a mechanism which serves to mechanically charge an energy store. The storage-charging mechanism can serve, for example, to tension a spring, for example to extend or compress a spring. Through the use of an, in particular, two-armed storage-charging lever it is possible to generate a rotational movement at the storage-charging lever, as result of which charging of an energy store is made possible. Through the use of two arms on the storage-charging lever it is also possible to provide that charging of the energy store can be brought about in different switched positions of the snap-action drive.

Furthermore, it can advantageously be provided that rotational axes of the swinging movable part and of the storage-charging lever are oriented coaxially.

A coaxial orientation of the swinging movable part and the storage-charging lever makes it possible to perform charging and discharging of an energy store in a mechanical fashion in a compact installation space. A coxial orientation permits the swinging movable part and the storage-charging lever to be spaced apart (in particular axially) and allows each of them to perform a rotational movement, wherein the rotational movement of the swinging movable part and the storage-charging lever can overlap one another.

A further object of the invention is to specify a switching device with switching contact pieces which can move relative to one another, wherein a relative movement of the movable switching contact pieces can be brought about by means of a snap-action drive. A switching device has here a snap-action drive with the features specified above.

A switching device, in particular an electrical switching device, serves to switch a phase conductor. For this purpose, the phase conductor is either disconnected or connected through. In order to switch the phase conductor, it is possible to use switching contact pieces which can move relative to one another and which are subjected to a relative movement by the snap-action drive. The use of a snap-action drive on a switching device ensures that a relative movement of the switching contact pieces for switching the switching device always takes place with a defined movement profile. In this context, there can be, in particular, provision that approximately identical movement profiles of the relative movements occur both during a switching-on process and during a switching-off process. An electrical switching device can be used, for example, in the medium voltage range and high voltage range in order to connect through or disconnect a phase conductor. In this context, the switching device may have a variety of designs. For example, the switching device can be a power switch, a circuit breaker, a grounding switch etc. In particular, fast-switching grounding switches can be activated during a switching-on process by means of a snap-action drive. When a snap-action according to the invention is used, both a switching-on process and a switching-off process of the switching device, in particular of a grounding switch, can be performed with a snap-action characteristic.

Other features which are considered as characteristic for the invention are set forth in the appended claims.

Although the invention is illustrated and described herein as embodied in a snap-action drive and a switching device having a snap-action drive, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
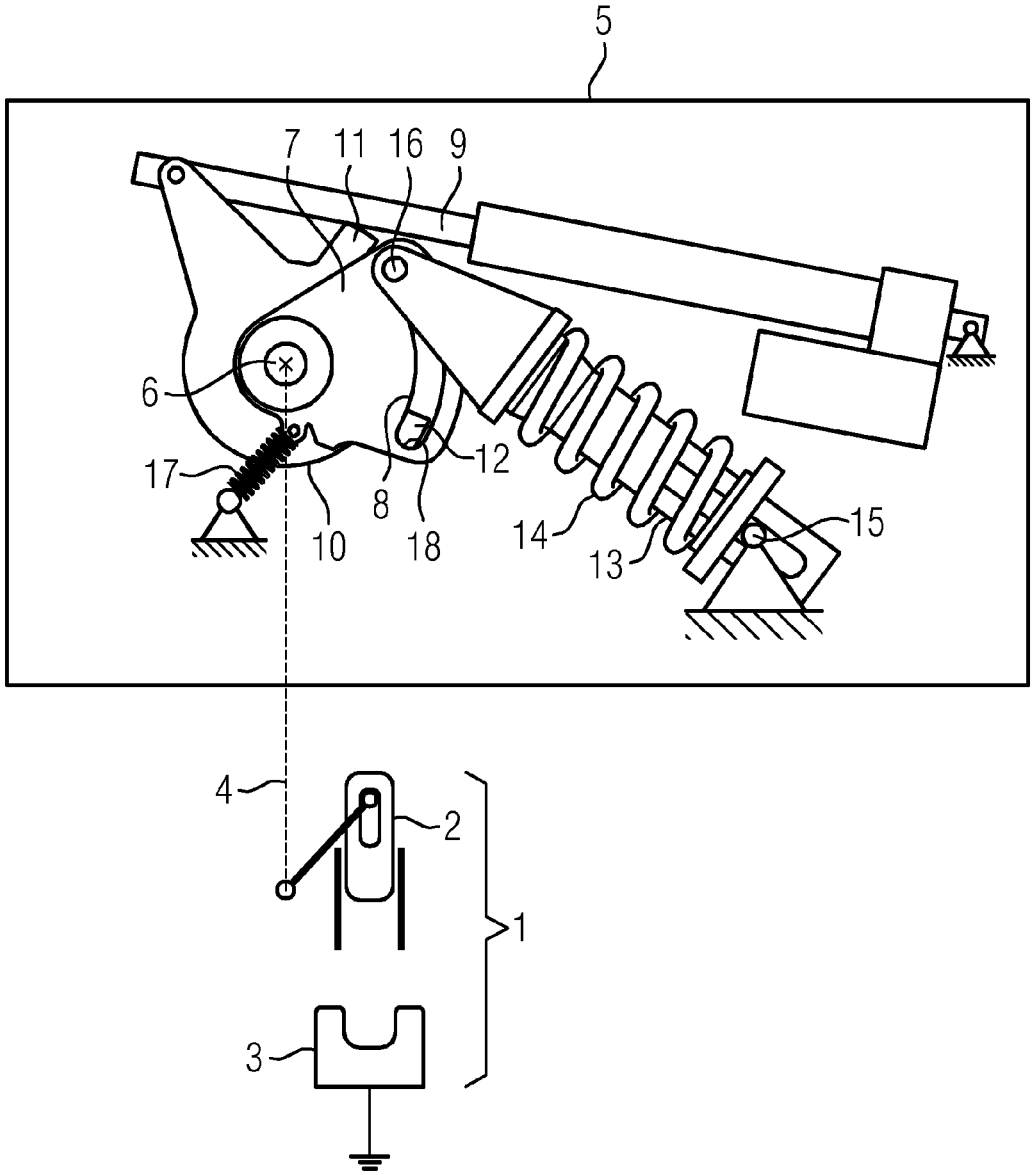
FIG. 1 is an illustration showing a snap-action drive in a switched-off state according to the invention.

Referring now to the figures of the drawings in detail and first, particularly to FIGS. 1-10 thereof, there is shown a snap-action drive 5 which serves to operate a switching device 1. The switching device 1 has a first switching contact piece 2 and a second switching contact piece 3. The two switching contact pieces 2, 3 can move linearly with respect to one another. End sides of the switching contact pieces 2, 3 which have complementary shapes face one another. The first switching contact piece 2 is connected to the snap-action drive 5 via a kinematic chain 4. A relative movement between the two contact pieces 2, 3 can be triggered by the snap-action drive 5. There is provision here that only the first switching contact piece 2 can be moved. It can also be provided that both the first and second switching contact pieces 2, 3 are arranged in a movable fashion. Correspondingly, if the kinematic chains are modified a movement can also be transmitted to both switching contact pieces 2, 3 in order to generate a relative movement. The second switching contact piece 3 is provided here with ground potential, with the result that the first switching contact piece 2 can conduct a ground potential via contact with the first switching contact piece 2. A reversal of the application of the ground potential can also be provided, with the result that, for example, ground potential is continuously applied to the first switching contact piece 2, and by switching on the switching device 1 ground potential can be applied to the second switching contact piece 3. As result it is possible, for example, to ground a phase conductor, which is to be grounded, via the switching device 1. Correspondingly, in this case the switching device 1 is referred to as a grounding switch. In this context, by virtue of the use of the snap-action drive 5 the grounding switch or the switching device 1 can function as a high-speed grounding switch, since snap-action switching off or switching on of both switching contact pieces 2, 3 takes place.

Figure 8:
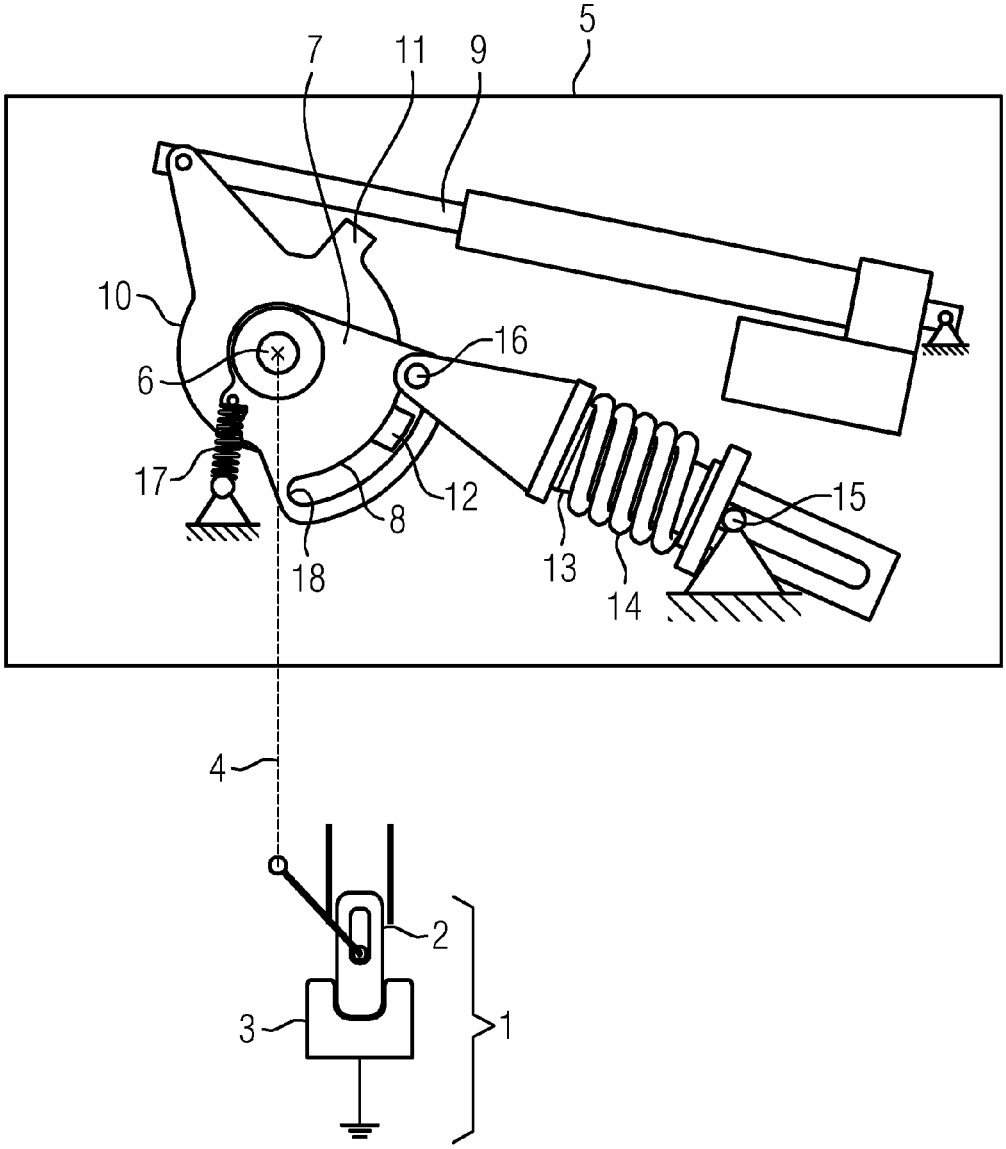
Figure 9:
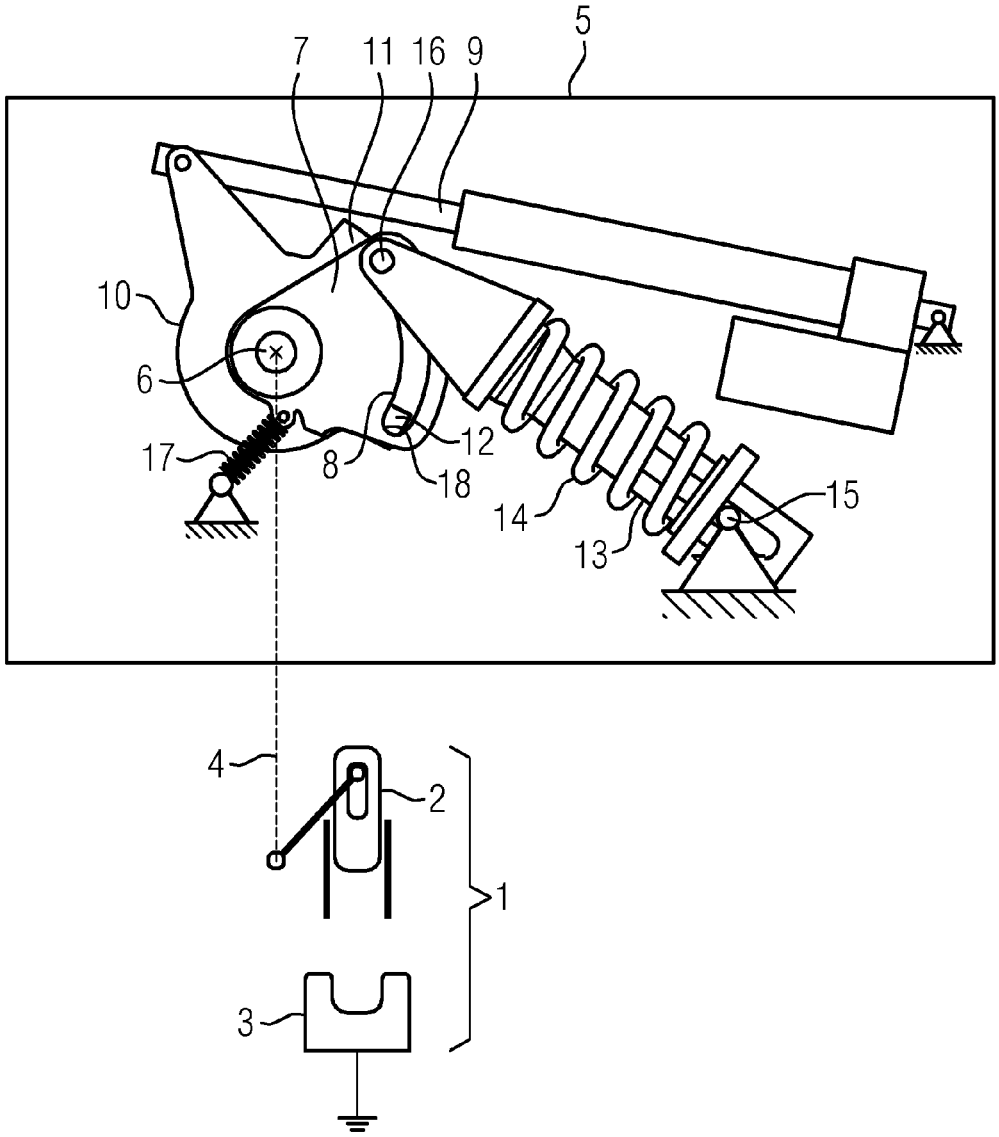
Figure 10:
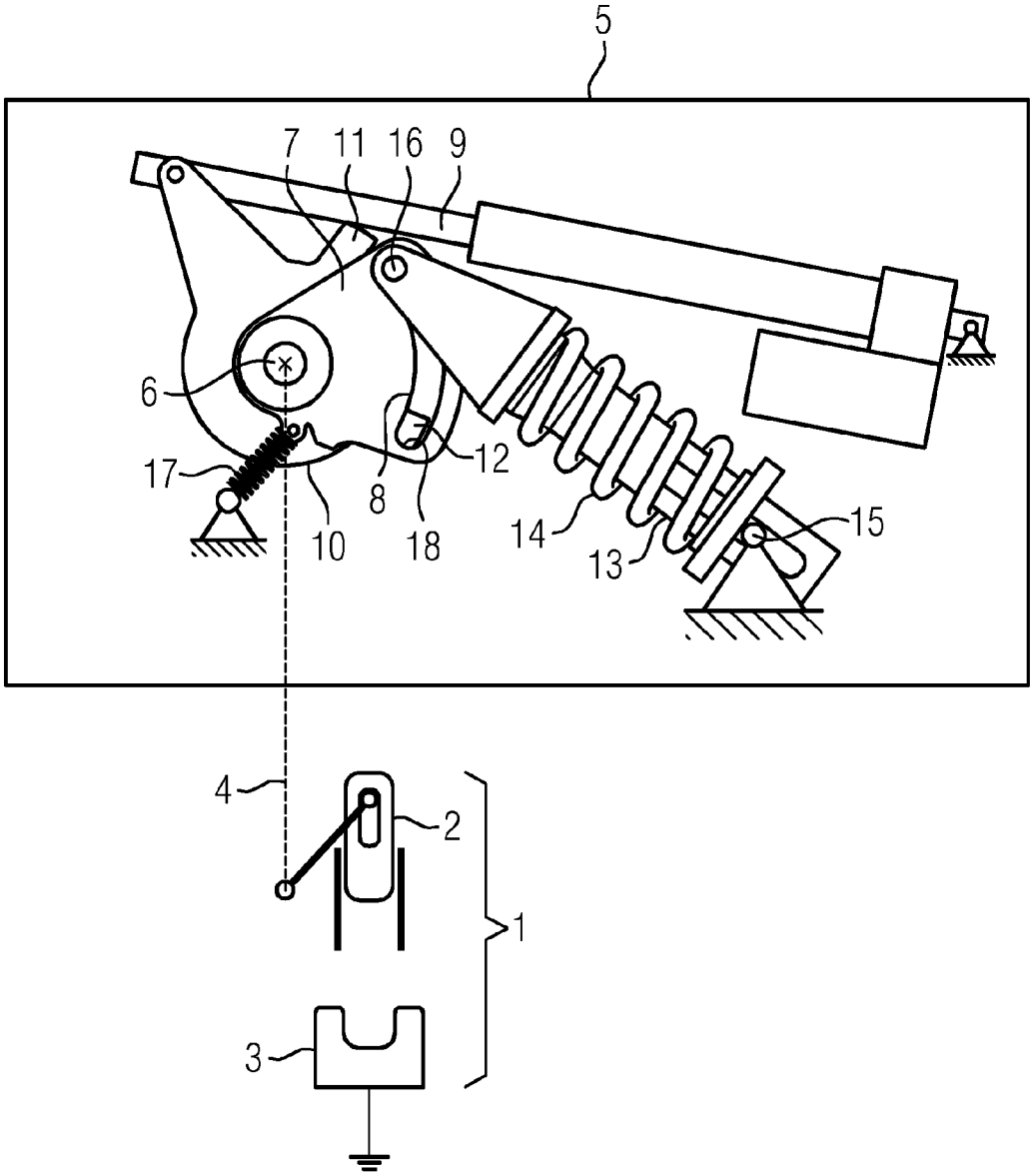
FIG. 10 is an illustration showing the snap-action drive in a switched-off state.

FIGS. 2 to 10 each represent the switched state of the switching device 1 with the first switching contact piece 2 and the second switching contact piece 3. The respective state of the snap-action drive 5 is represented in a complementary fashion with respect to the latter. In FIG. 1, the switching device 1 has a switched-off position, i.e. the switching contact pieces 2, 3 are electrically insulated from one another. FIG. 10 shows an identical switched-off position of the switching device 1. FIGS. 1 and 10 represent the snap-action drive 5 in the same state. The sequence of a switching-on movement at the switching device 1 and the corresponding sequences in the snap-action drive 5 are illustrated starting from the switched-off position in FIG. 1 via FIGS. 2, 3 and 4. A reversal of the switching device 1 from its switched-on position into its switched-off position is represented starting from the switched-on position in FIG. 5 via FIGS. 6, 7, 8, 9 and 10, wherein the respective sequences of the snap-action drive 5 are shown in the figures. FIGS. 1 and 10 correspond to one another here.

Firstly, the design of a snap-action drive 5 will be described in more detail with respect to FIG. 1. The snap-action drive 5 has a gear mechanism. The gear mechanism is provided with a gear shaft 6. The gear shaft 6 is part of the kinematic chain 4 which transmits a relative movement to the two switching contact pieces 2, 3. The gear shaft 6 is mounted in a positionally fixed fashion. A swinging movable part 7 is seated on the gear shaft 6. The swinging movable part 7 is embodied in the manner of a lever which projects radially from the gear shaft 6. A slotted link 8 is arranged on the swinging movable part 7. The slotted link 8 is arranged in the form of a continuous recess in the swinging movable part 7. The slotted link 8 is in the shape of a circular segment, wherein the circular segment is oriented coaxially with respect to the rotational axis of the gear shaft 6.

A storage-charging mechanism has a linear drive 9. The linear drive 9 is oriented in a positionally fixed fashion with respect to the bearing of the gear shaft 6. A linear movement can be generated by means of the linear drive. The linear drive acts on a storage-charging lever 10. The storage-charging lever 10 is embodied as a two-armed storage-charging lever and has a first driver 11 and a second driver 12. A movement can be input into the rotatably mounted storage-charging lever 10 by use of the linear drive 9, with the result that a rotational movement of the storage-charging lever 10 can take place. In this context, the rotational axes of the storage-charging lever 10 and of the swinging movable part 7 are oriented coaxially. The drivers 11, 12 project radially to such an extent that when a rotational movement occurs and the slotted link 8 is passed through they project into the slotted link 8.

The snap-action drive 5 also has an energy store 13. The energy store 13 is equipped with a storage spring 14. The storage spring 14 is a compression spring which bears with one of its ends on a positionally fixed bearing point 15. The positionally fixed bearing point is positioned here with a rigid angle with respect to the linear drive 9 and with respect to the bearing of the gear shaft 6. In this context, the positionally fixed bearing point 15 is embodied in such a way that a pivoting movement of the energy store 13 about the positionally fixed bearing point 15 is made possible. As a result, a change in length, which is performed when the energy store 13 is compressed, can be transferred from a pivoting movement about the positionally fixed bearing point 15, with the result that a rotational movement of the energy store 13 about the positionally fixed bearing point 15 is made possible. A linear displacement of the energy store 13 can be superimposed on a pivoting movement about the positionally fixed bearing point 15. At the end facing away from the positionally fixed bearing point 15, the energy store 13 can be equipped with a bolt 16, wherein the bolt 16 projects into the slotted link 8. Therefore, forcible guidance of the bolt 15 takes place within the slotted link 8. That is to say when there is rotational movement of the energy store 13 about the positionally fixed bearing point 15, the bolt 16 and the end of the energy store 13 facing away from the positionally fixed bearing point 15 can move freely within the slotted link 8. As a result, a forced change in the distance from the positionally fixed bearing point 15 to the bolt 16 can be forcibly brought about, by which means tensioning or relaxing of the storage spring 14 of the energy store 13 can be forcibly brought about.

In order to secure the swinging movable part 7 in the respective end positions of a swinging movement, a securing device 17 is provided. The securing device 17 has a compression spring which is positioned in a positionally fixed fashion by one of its ends and is attached by its other end to the swinging movable part 7. In this context, the attachment point to the swinging movable part 7 is selected such that the securing device 17 presses the swinging movable part 7 into an end position in each case, wherein between the end positions which form a stable position with the securing device 17 there is an unstable position within which the securing device 17 acts as a dead-center spring (see switching over between FIGS. 4 and 3, changeover of the position of the securing device 17).

FIG. 1 shows a switched-off position of the switching device 1. In the text which follows, a changeover of the switched state of the switching device from OFF to ON using the snap-action drive 5 will be described with reference to FIGS. 1, 2, 3 and 4.

In the case of a switching-on process, the linear drive 9 is firstly activated, as result of which a rotational movement is transmitted in the clockwise direction to the storage-charging lever 10. The storage-charging lever 10 rotates about its rotational axis, wherein the first driver 11 dips in a radially protruding fashion about the hatched area of the swinging movable part 7 and in the process moves into the slotted link 8. The first driver 11 impacts against the bolt 16 of the energy store 13 there and drives the bolt 16 through the slotted link 8 in the clockwise direction.

Figure 2:
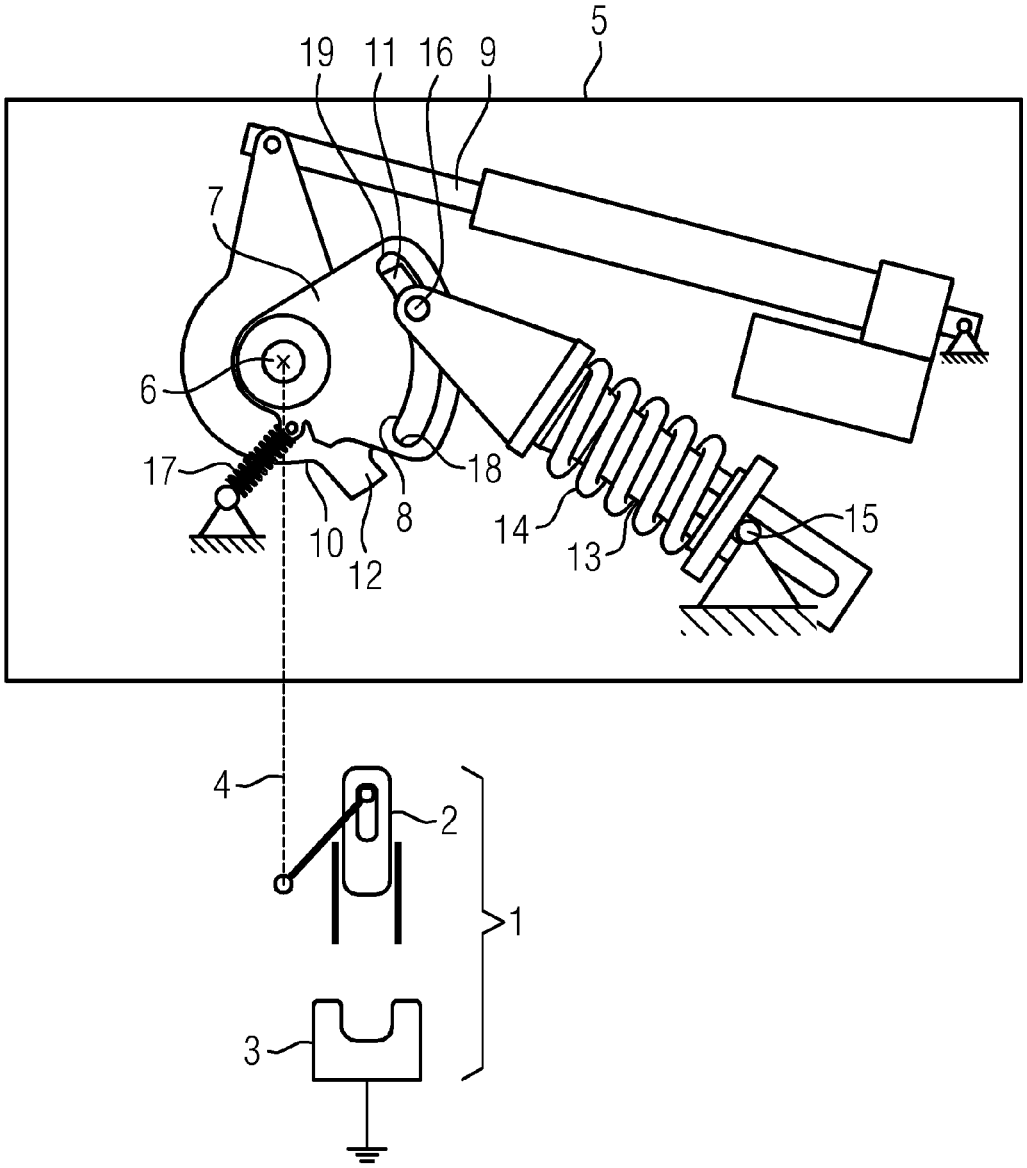
FIGS. 2, 3 and 4 are illustrations showing sequences of a movement of the snap-action drive during a switching-on process.

FIG. 2 shows an advanced position of the first driver 11 of the storage-charging lever 10, wherein shortening of the distance from the positionally fixed bearing point 15 to the bolt 16 occurs with the compression of the storage spring 14 of the energy store 13. Being secured by the securing device 17, the swinging movable part 7 remains at rest. The switching device 1 and the switching contact pieces 2, 3 of the switching device 1 remain at rest. Subsequently, the first driver 11 drives the bolt 16 through the slotted link 8, as result of which increasing charging of the energy store (compression of the storage spring 14) takes place. The securing device 17 acts against the friction forces acting between the energy store 13 (in particular bolt 16) and the swinging movable part 7 (in particular slotted link 8), with the result that the swinging movable part 7 remains at rest.

Figure 3:
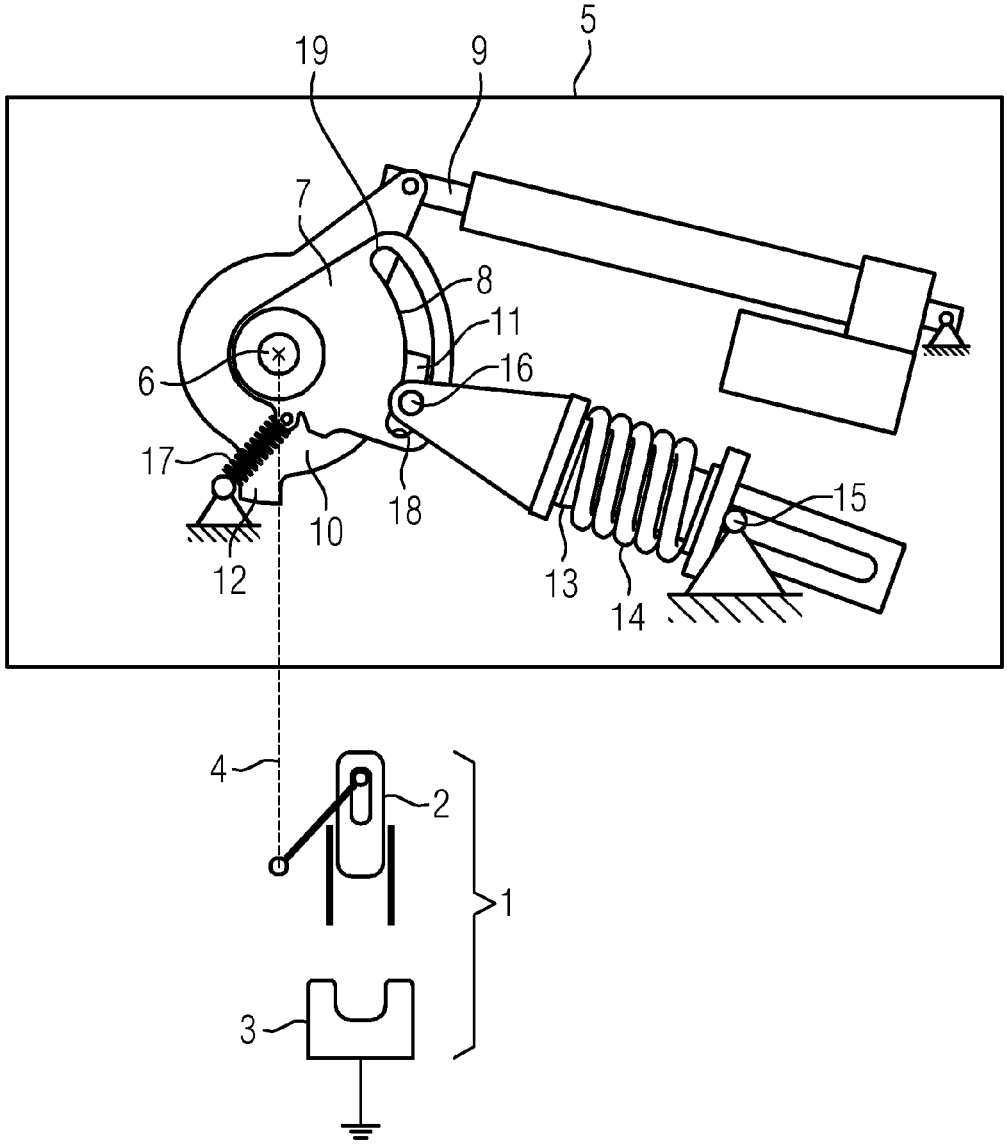
Figure 4:
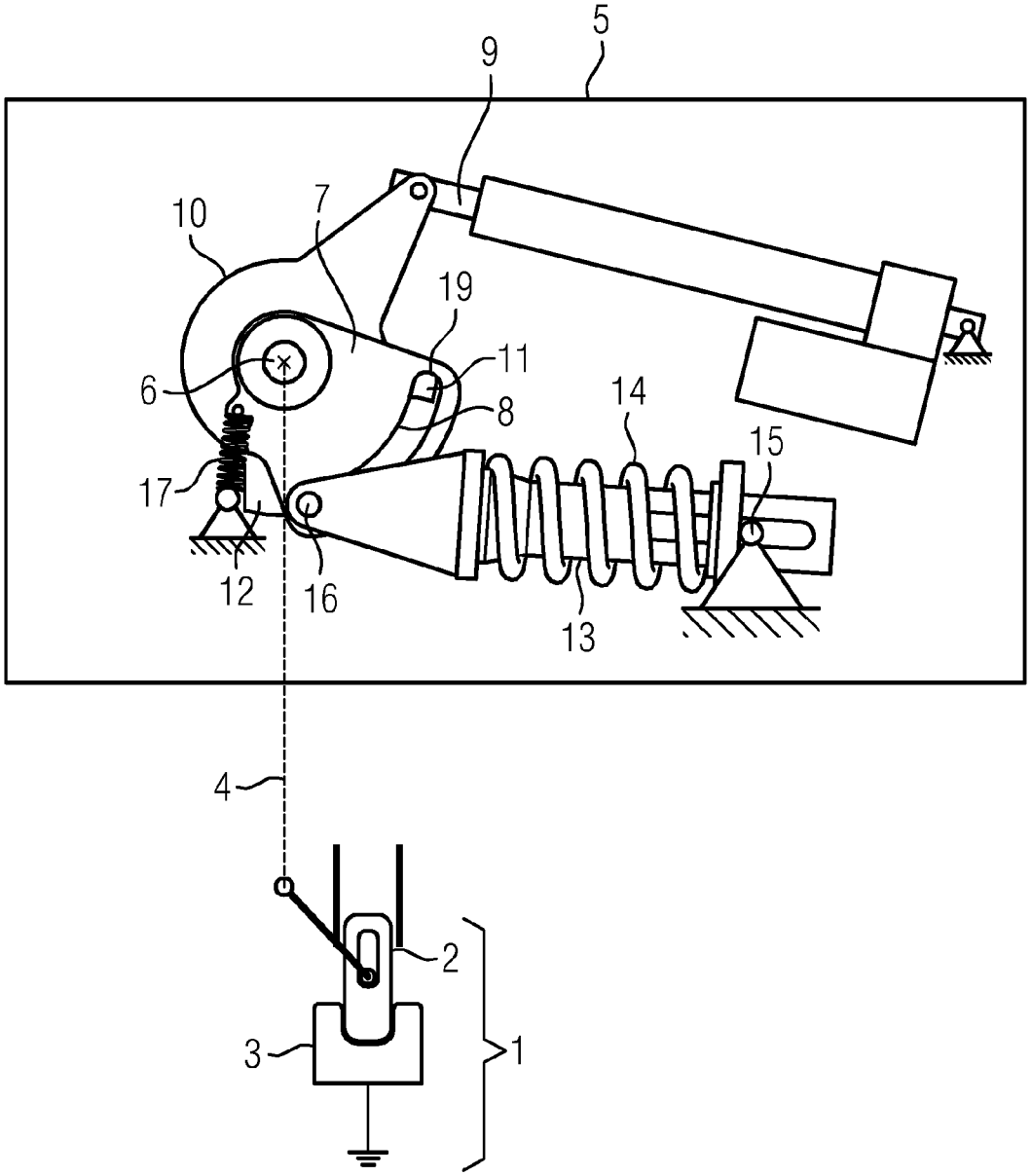

The energy store 13, in particular the storage spring 14, is in the dead-center position according to FIG. 3. In the dead-center position, the direction of action of the energy store 13 runs through the rotational axis of the oscillating movable part 7. When this dead-center position is passed through, driven by the first driver 11, the energy store 13/the bolt 16 leaves the dead-center position and impacts against an end stop 18 of the slotted link 8, on which the storage spring 14 presses to bring about discharging. The generation of force by the energy store 13 which now occurs is greater here than the force effect of the securing device 17, with the result that the force effect of the securing device 17 is overcome by the energy store 13. The securing device 17 or its compression spring firstly runs through a dead center, wherein the force effect of the securing device 17 is directed toward the force effect of the energy store 13 until the dead center is reached. When the dead center position of the securing device 17 is moved through, the direction of the force effect of the securing device 17 changes and assists the driving force of the energy store 13 and drives, together with the energy store 13, the swinging movable part 7 on the basis of the bolt 16 bearing against the end stop 18, as result of which a rotational movement of the gear shaft 6 is forcibly brought about. The first and second switching contact pieces 2, 3 are subjected to a relative movement. The two switching contact pieces 2, 3 are in contact with one another. This position is shown in FIG. 4. In order to permit positions to be secured by means of the securing device 17, the second driver 12 is moved completely out of the slotted link 8 by the first and second switching contact pieces 2, 3 (FIG. 5) upon reaching the switched-on position. The swinging movable part 7 is now held by the securing device 17 in a second end position of the swinging movable part 7 (if appropriate supported by the pre-tensioned energy store 13).

Figure 5:
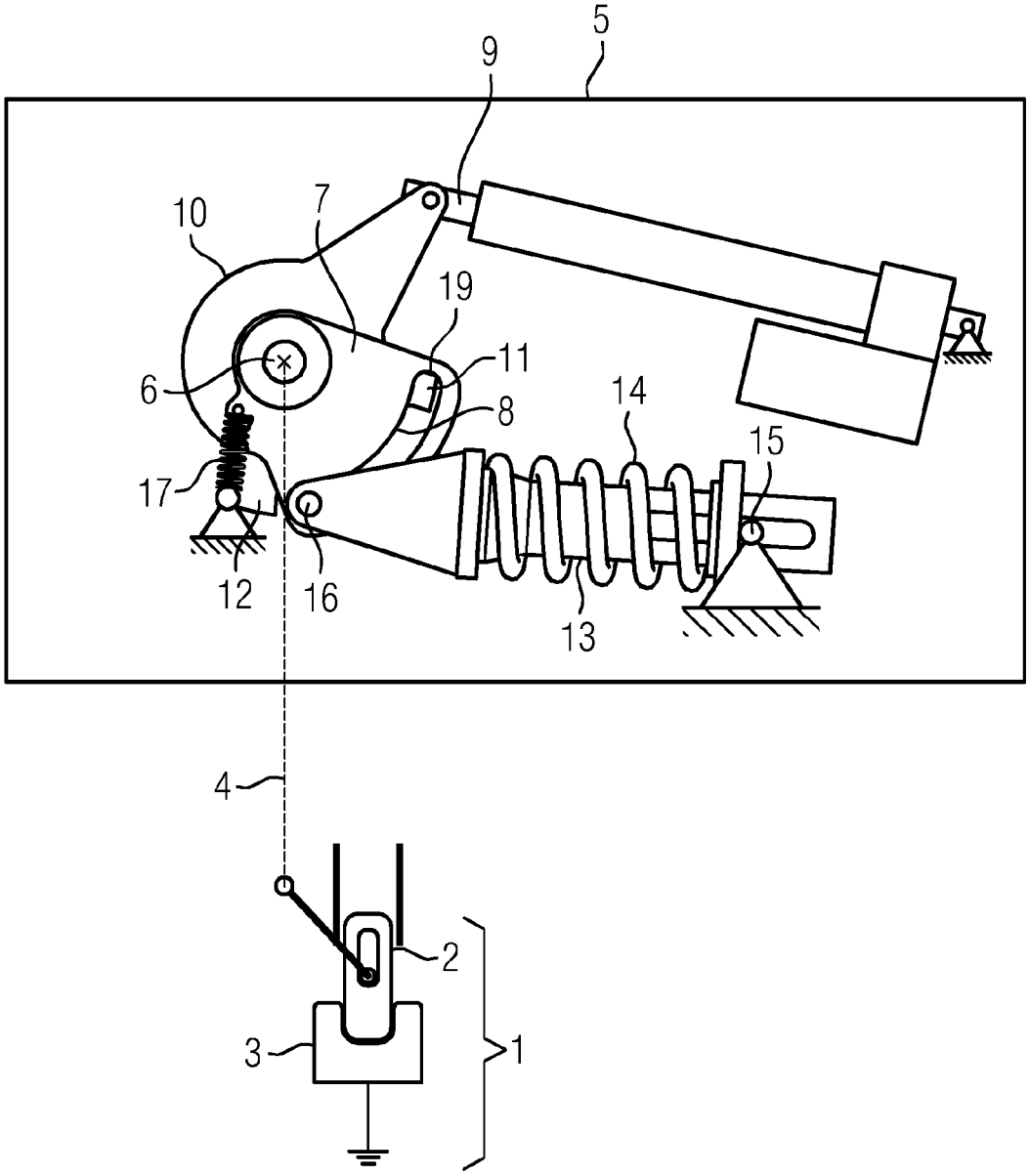
FIG. 5 is an illustration showing the snap-action drive in a switched-on state.
Figure 6:
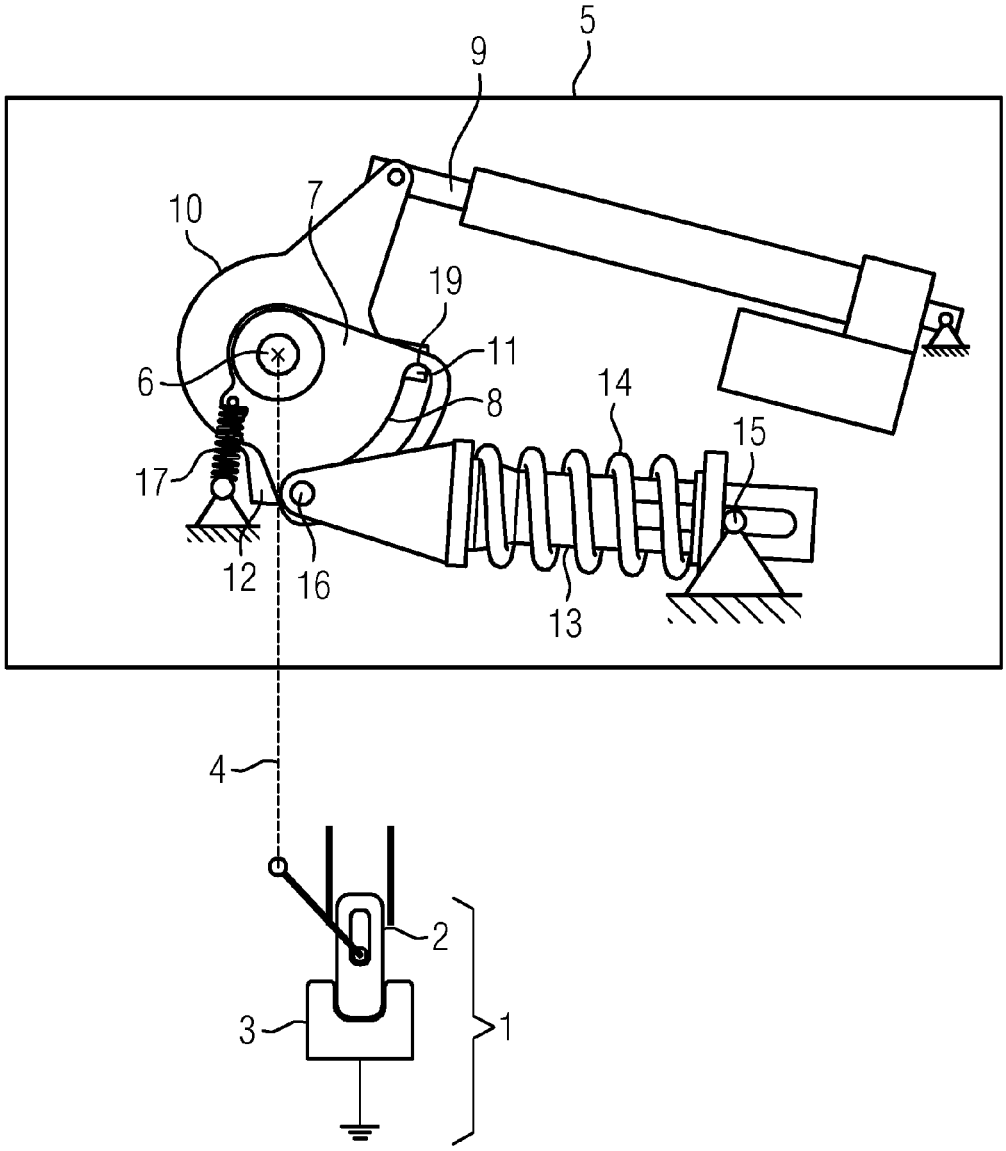
FIGS. 6, 7, 8 and 9 are illustrations showing sequences of a movement of the snap-action drive during a switching-off process.
Figure 7:
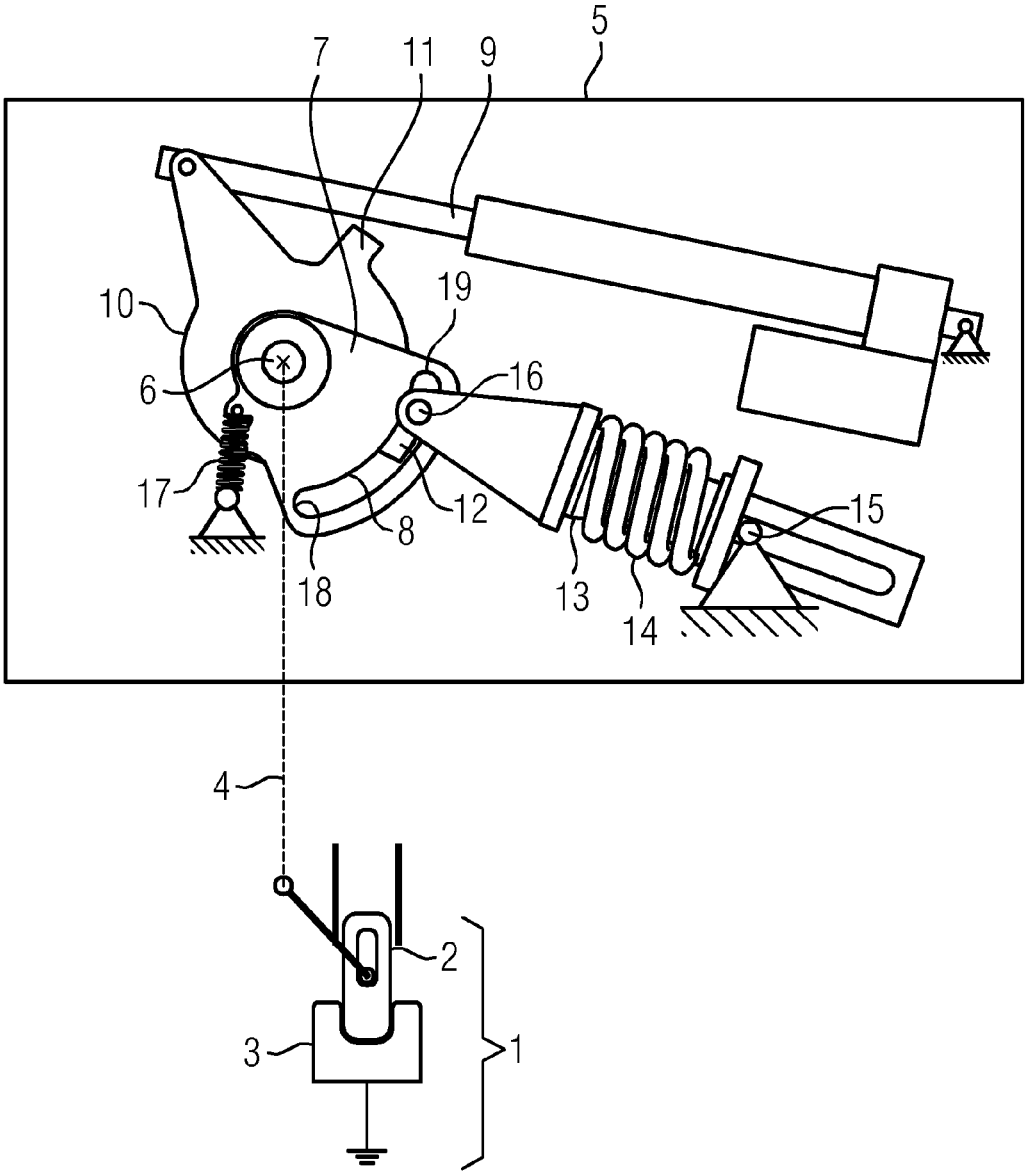

A switching-off movement is shown starting from FIG. 5 via FIGS. 6, 7, 8, 9 and 10. In this context, the movement which is to be transmitted to gear shaft 6 is reversed. The linear drive 9 drives the storage-charging lever 10 in the counterclockwise direction, as result of which the second driver 12 is moved into the slotted link 8. The second driver 12 comes into contact there with the bolt 16 of the energy store 13 (see changeover from FIG. 5 to FIG. 6), as result of which the bolt 16 is driven into the slotted link 8. The swinging movable part 7 is held in a positionally fixed fashion under spring loading by the securing device 17. Furthermore, as the rotational movement of the storage-charging lever 10 proceeds in the counterclockwise direction the bolt 16 is driven by the slotted link 8 up to the time at which the energy store 13 assumes a dead-center position (FIG. 7) with the storage spring 14 in the charged state. That is to say the force effect of the energy store 13/of the storage spring 14 runs through the center of rotation of the gear shaft 6. When the bolt 16 is driven by the dead center of the energy store 13 (brought about by the second drive 12), the now charged energy store 13 discharges. The energy store 13 with its bolt 16 impacts against a second end stop 19 of the slotted link 8, wherein the force effect of the securing device 17 first has to be overcome by the energy store 13. The swinging movable part 7 is continuously force-loaded by the securing device 17 and is driven out from a stable end position (this state is illustrated in FIG. 7). In FIG. 8 the dead-center position of the energy store 13 has just been left. The bolt 16 has become detached from the second driver 12 and impacts against the second end stop 19 and is about to move the swinging movable part 7 in the counterclockwise direction and by this means trigger a movement of the gear shaft 6. FIG. 9 shows snap-action-like shifting of the swinging movable part 7 and a corresponding snap-action-like switching-off movement of the switching contact pieces 2, 3 which can move relative to one another. The linear drive 9 then pushes the first driver 11 out of the slotted link 8, with the result that the end position of the swinging movable part 7 is secured by using the force effect of the securing device 17.

The invention claimed is:

1. A snap-action drive for a switching device, the snap-action drive comprising:

an energy store;

a gear mechanism having a swinging movable part, wherein said swinging movable part acting as a lag element in said gear mechanism; and a securing device for said swinging movable part, a reversal of direction of said swinging movable part takes place counter to a force effect of said securing device.

2. The snap-action drive according to claim 1, wherein said swinging movable part and said securing device form a bistable system.

3. The snap-action drive according to claim 1, wherein said swinging movable part assumes an unstable state when said energy store is charged.

4. The snap-action drive according to claim 1, wherein said gear mechanism has a slotted link, by means of said slotted link at least one of charging or discharging of said energy store is controlled.

5. The snap-action drive according to claim 4, wherein said slotted link has at least one end stop for bounding a movement which can be output by said gear mechanism.

6. The snap-action drive according to claim 1, wherein said swinging movable part is mounted in a rotationally movable fashion.

7. The snap-action drive according to claim 1, further comprising a storage charging mechanism having a two-armed storage-charging lever which is rotatably mounted.

8. The snap-action drive according to claim 7, wherein rotational axes of said swinging movable part and said two-armed storage-charging lever are oriented coaxially.

9. A snap-action drive for a switching device, the snap-action drive comprising:

an energy store;

a gear mechanism having a swinging movable part;

a securing device for said swinging movable part, a reversal of direction of said swinging movable part takes place counter to a force effect of said securing device, wherein said securing device has a dead-center spring; and said swinging movable part and said securing device forming a bistable system.

10. The snap-action drive according to claim 9, wherein said energy store has a dead-center spring.

11. The snap-action drive according to claim 10, wherein a dead center of said dead-center spring of said securing device and of said energy store apply force effects to said swinging movable part in opposing directions.

12. The snap-action drive according to claim 10, wherein traversing of a dead center of said dead-center spring of said energy store, causes a stable state of said bistable system to change.

13. The snap-action drive according to claim 10, wherein a dead center of said dead-center spring of said securing device and of said energy store are traversed in chronological succession.

14. The snap-action drive according to claim 9, wherein said swinging movable part is driven by outputting of energy from said energy store of the snap-action drive.

15. A switching device, comprising:

a snap-action drive containing an energy store, a gear mechanism having a swinging movable part where said swinging movable part acts as a lag element in said gear mechanism, and a securing device for said swinging movable part, a reversal of direction of said swinging movable part taking place counter to a force effect of said securing device; and switching contact pieces which can move relative to one another and whose relative movement can be brought about by said snap-action drive.

* * * * *